US009600998B2

(12) United States Patent
Mumey

(10) Patent No.: US 9,600,998 B2
(45) Date of Patent: Mar. 21, 2017

(54) SYSTEM, APPARATUS, AND METHOD FOR SENSING GAS

(71) Applicant: Joel Lee Mumey, Anchor Point, AK (US)

(72) Inventor: Joel Lee Mumey, Anchor Point, AK (US)

( * ) Notice: Subject to any disclaimer, the term of this patent is extended or adjusted under 35 U.S.C. 154(b) by 29 days.

(21) Appl. No.: 14/793,085

(22) Filed: Jul. 7, 2015

(65) Prior Publication Data

US 2016/0019769 A1 Jan. 21, 2016

Related U.S. Application Data

(60) Provisional application No. 62/074,278, filed on Nov. 3, 2014, provisional application No. 62/025,333, filed on Jul. 16, 2014.

(51) Int. Cl.

| | |
|---|---|
| ***G08B 21/18*** | (2006.01) |
| ***G08B 7/06*** | (2006.01) |
| ***G08B 21/14*** | (2006.01) |
| *G08B 21/16* | (2006.01) |

(52) U.S. Cl.

CPC ..... *G08B 21/14* (2013.01); *G08B 21/16* (2013.01)

(58) Field of Classification Search

None

See application file for complete search history.

(56) References Cited

U.S. PATENT DOCUMENTS

| | | | | |
|---|---|---|---|---|
| 2,043,857 | A | 6/1936 | Montgomery | |
| 5,508,568 | A * | 4/1996 | Mammen | G08B 1/08 307/117 |
| 5,625,345 | A | 4/1997 | Stark et al. | |
| 5,828,307 | A | 10/1998 | Washer | |
| 7,154,402 | B2 * | 12/2006 | Dayoub | G08B 17/10 340/628 |
| 7,515,058 | B2 * | 4/2009 | Normand | G08B 17/10 340/538 |
| 8,836,520 | B1 | 9/2014 | Crook | |
| 8,836,522 | B2 | 9/2014 | Thorpe et al. | |
| 2004/0218330 | A1 * | 11/2004 | Natili | H02H 1/0023 361/115 |
| 2008/0018484 | A1 | 1/2008 | Sager | |
| 2008/0094210 | A1 * | 4/2008 | Paradiso | H04L 12/2827 340/540 |

(Continued)

*Primary Examiner* — Quan-Zhen Wang
*Assistant Examiner* — Chico A Foxx

(57) ABSTRACT

According to another exemplary embodiment, a method of cutting power from a source when sensing gas may be provided. The method of cutting a power from a source when sensing gas may include obtaining a gas sensing apparatus, which may a housing, at least one power relay rigidly connected to the inside of the housing, at least one sensor connected to the power relay, at least one alarm connected to the at least one sensor, at least one port power wire outlet connected to the power relay, at least one power socket connected to the power relay, a power transformer connected to the power relay, and a power inlet connected to the power transformer, connecting the gas sensing apparatus to a power supply, connecting an electrical device to the gas sensing apparatus, sensing gas by the sensor, creating a voltage that stops power flow to the at least one outlet, and applying a voltage to the at least one port power wire outlet.

1 Claim, 8 Drawing Sheets

(56) References Cited

U.S. PATENT DOCUMENTS

| | | | | |
|---|---|---|---|---|
| 2008/0180261 | A1* | 7/2008 | Shirlee | G08B 17/10 340/632 |
| 2008/0182215 | A1* | 7/2008 | Sid | B60K 28/10 431/18 |
| 2010/0201531 | A1* | 8/2010 | Pakravan | G08B 29/20 340/632 |
| 2010/0307600 | A1 | 12/2010 | Crucs | |
| 2014/0180486 | A1 | 6/2014 | Newman, Jr. et al. | |
| 2015/0077243 | A1* | 3/2015 | Hooper | H02H 3/16 340/532 |
| 2016/0232774 | A1* | 8/2016 | Noland | G06Q 10/00 |

* cited by examiner

SYSTEM, APPARATUS, AND METHOD FOR SENSING GAS

PRIORITY CLAIM

This application claims the benefit of the filing date of U.S. Patent Application No. 62/074,278, filed Nov. 3, 2014, which is incorporated herein by reference in its entirety and U.S. Patent Application No. 62/025,333, filed Jul. 16, 2014, which is incorporated herein by reference in its entirety.

BACKGROUND

A number of devices have been developed to prevent common accidents caused by malfunctioning or old appliances that either leak dangerous gases such as carbon monoxide (CO), or may produce sparks capable of igniting a flammable gas leak that may result in a fire or explosion. CO poisoning may occur after a person is exposed to levels superior to 100 ppm. Additionally, CO is especially dangerous because it is virtually odorless and usually remains undetected until symptoms of poisoning start to appear. Carbon monoxide may be produced in domestic or industrial settings by incomplete combustion of hydrocarbons due to insufficient oxygen supply. CO may be produced by motor vehicles running on gasoline, diesel, methane, or other carbon-based fuels. Further, a number of appliances such as gas heaters and stoves burning propane or butane may also produce CO. These hazards may not only be present at home, but also in the workplace, especially in industrial settings where a number of engines may be operated in the same enclosed space. In addition, Industrial settings may present even more harmful gases such as hydrogen sulfide ($H_2S$), a colorless gas with a very distinctive rotten eggs odor. $H_2S$ is very poisonous and explosive and therefore needs to be detected at very low concentration in the atmosphere.

Therefore, there is a great need for a device that may not only be able to trigger warning lights and sirens when it detects traces of a poisonous or explosive gas, but may also be able to cut power to electric devices and appliances. Thereby preventing accidental sparks to start an explosion or fire. An effective detection system should be able to alert people in the vicinity of an imminent danger but also be able to autonomously cut the power immediately when a leak is detected. Such a system would be especially useful in a remote and deserted building such as storages units or vacation homes.

SUMMARY

According to an exemplary embodiment, a gas sensing apparatus may be provided. The gas sensing apparatus may include a housing, at least one power relay rigidly connected to the inside of the housing, at least one sensor connected to the power relay, at least one alarm connected to the at least one sensor, at least one port power wire outlet connected to the power relay, at least one power socket connected to the power relay, a power transformer connected to the power relay, and a power inlet connected to the power transformer.

According to another exemplary embodiment, a method of cutting power from a source when sensing gas may be provided. The method of cutting a power from a source when sensing gas may include obtaining a gas sensing apparatus, which may include a housing, at least one power relay rigidly connected to the inside of the housing, at least one sensor connected to the power relay, at least one alarm connected to the at least one sensor, at least one port power wire outlet connected to the power relay, at least one power socket connected to the power relay, a power transformer connected to the power relay, and a power inlet connected to the power transformer, connecting the gas sensing apparatus to a power supply, connecting an electrical device to the gas sensing apparatus, sensing gas with the sensor, creating a voltage that stops power flow to the at least one outlet, and applying a voltage to the at least one port power wire outlet.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

FIG. **4*a*-4*e* are wiring diagrams showing an exemplary embodiment of the gas sensing apparatus.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
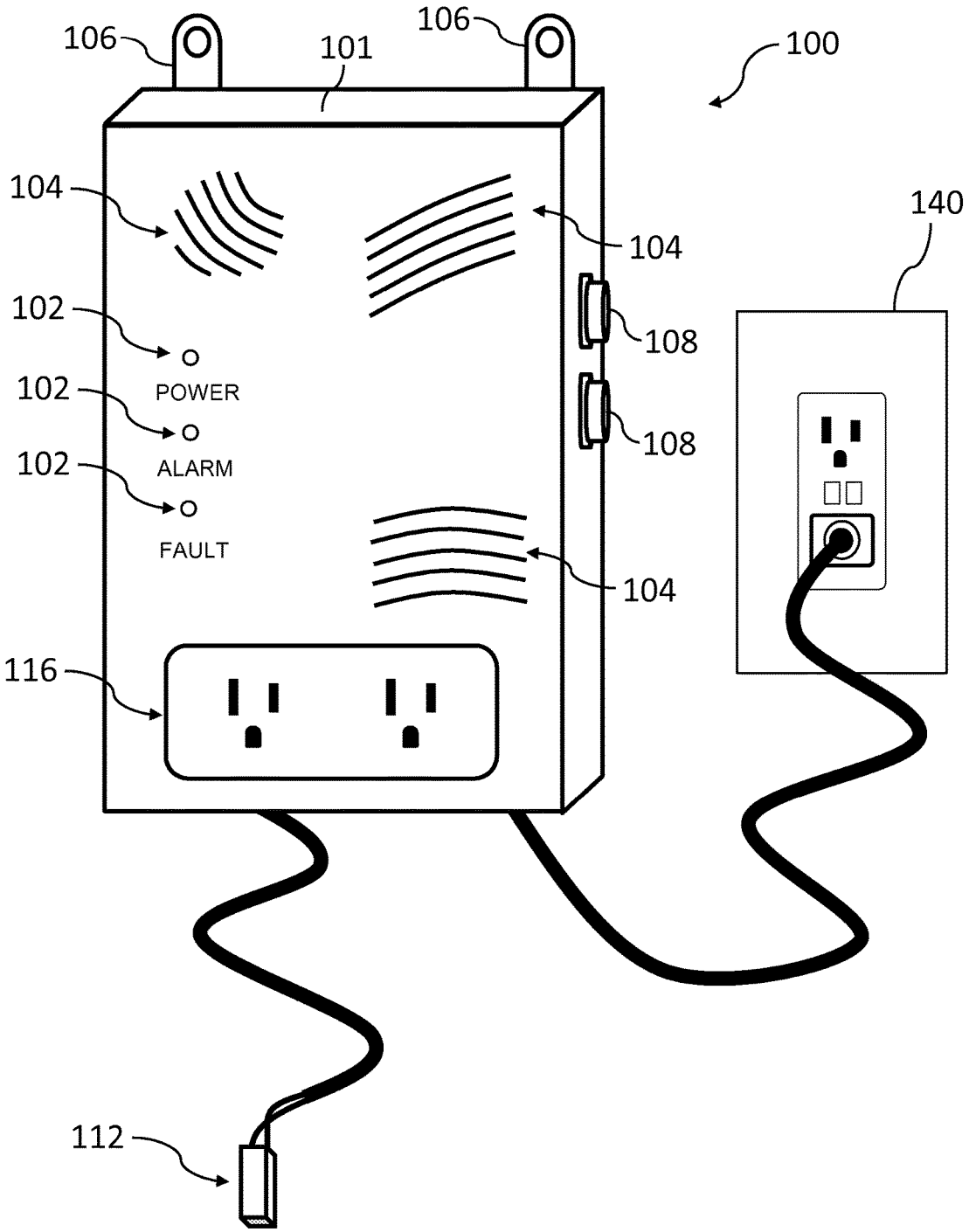
FIG. 1 is a drawing showing an exemplary embodiment of a perspective view of the gas sensing apparatus.

An exemplary embodiment of the gas sensing apparatus 100 may be illustrated in FIG. 1, the gas unit may be contained in a housing 101. The at least one side of the housing 101 may have a number of openings 104 and may also have a number of mounting elements 106 to rigidly connect the housing to a desired location. The openings 104 may allow the gaseous molecules or particles in the air around to penetrate the housing 101 and be detected by sensors that may be situated inside the housing. A number of switches 108 may be integrated to the housing. The switches 108 may have a number of functions, including but not limited to: resetting the gas sensor apparatus, manually cutting the power to the outlets, selecting outlets, testing the alarm, and testing the sensors. A number of warning lights 102 may be inserted thought the housing material in such a way that they may be connected to the electrical elements inside the housing 100 and display light outside of the housing 101. A number of power sockets 116 may also be rigidly connected to a side of the housing. The power sockets 116 may be connected to the electrical elements inside the housing and may be accessible from outside the housing 101 to connect an electrical device. The gas sensing apparatus 100 may be connected to a power supply 140. A port power wire outlet 112 may be connected to the electrical elements inside the housing on one end and to a number of safety devices on the other end. Safety devices may include a siren, a warning light, and a shunt trip breaker. It may be appreciated that any desired safety devices may be connected to the port power wire outlet 112.

Figure 2:
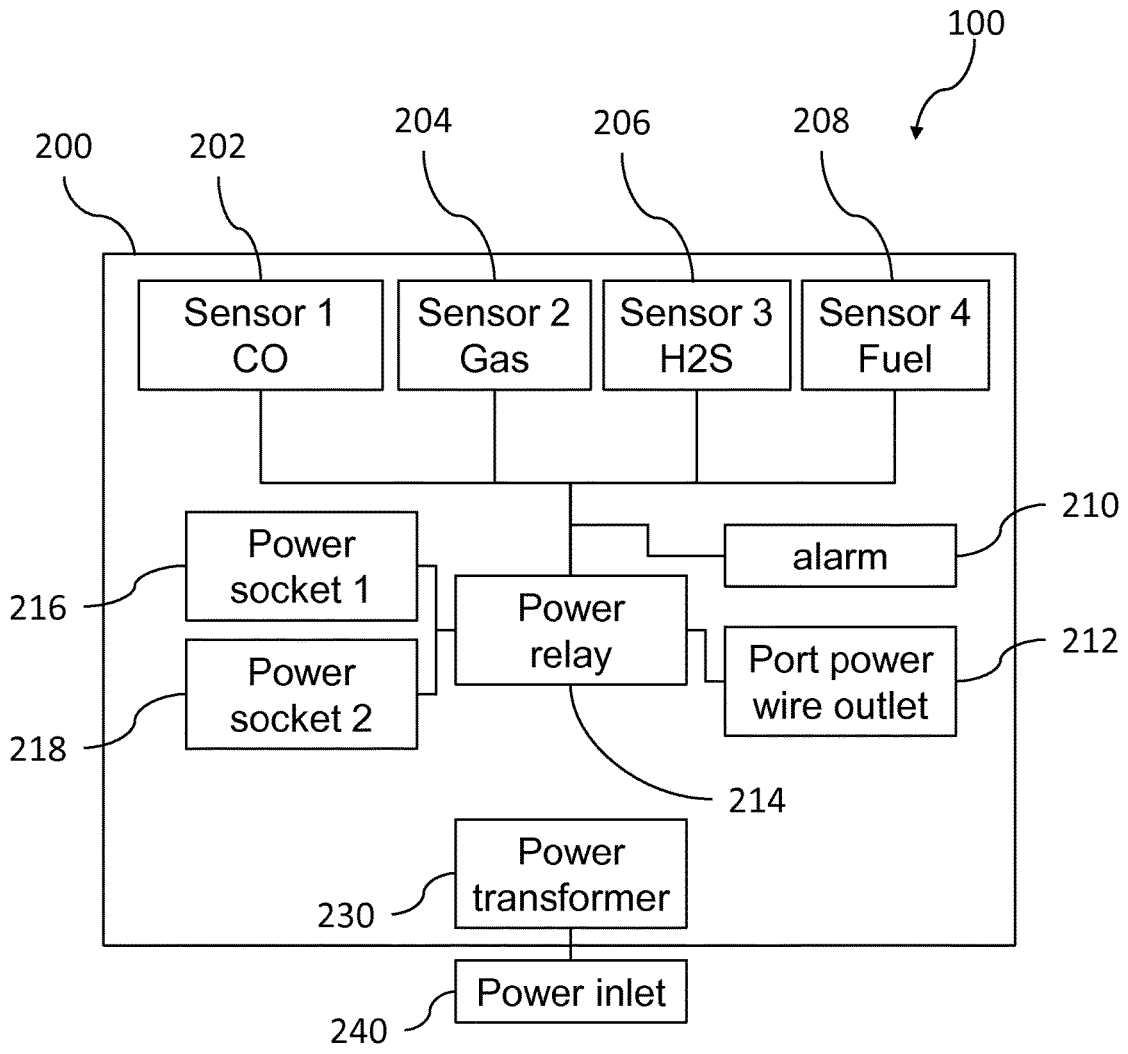
FIG. 2 is a diagram showing an exemplary embodiment of the gas sensing apparatus elements and connections.

In an exemplary embodiment, the gas sensing apparatus 100 may be described in FIG. 2, a power inlet 240 may be connected to a power transformer 230. The power transformer 230 may be connected and may supply power to a main board 200. A number of sensors 202,204,206,208 may be connected to the main board and to a power relay 214. The sensors may detect gaseous molecules or particles in the air surrounding the gas sensing apparatus. It may be appreciated that any desired sensors may be used, including, but not limited to: a gas sensor 204, a carbon monoxide sensor 202, a hydrogen sulfite sensor 206, and a fuel sensor 208. The sensors may send a signal to both the alarm 210 and the power relay 214. The alarm may be a warning system including, but not limited to: warning light, sirens, audible messages, radio message, and electronic message. It may be appreciated that the message and signals may be directed to persons in the vicinity of the gas sensing apparatus but may also be directed to a remote location. In turn, the power relay may shut down power to the two power sockets 216,218 and may power up a port power wire outlet 212. In an exemplary embodiment, the power socket 216,218 and the port power wire outlet 212 may deliver an alternative current with a voltage of about 110V. However, it may be appreciated that the gas sensing apparatus may be adapted to deliver any desired voltage and amperage.

Figure 3:
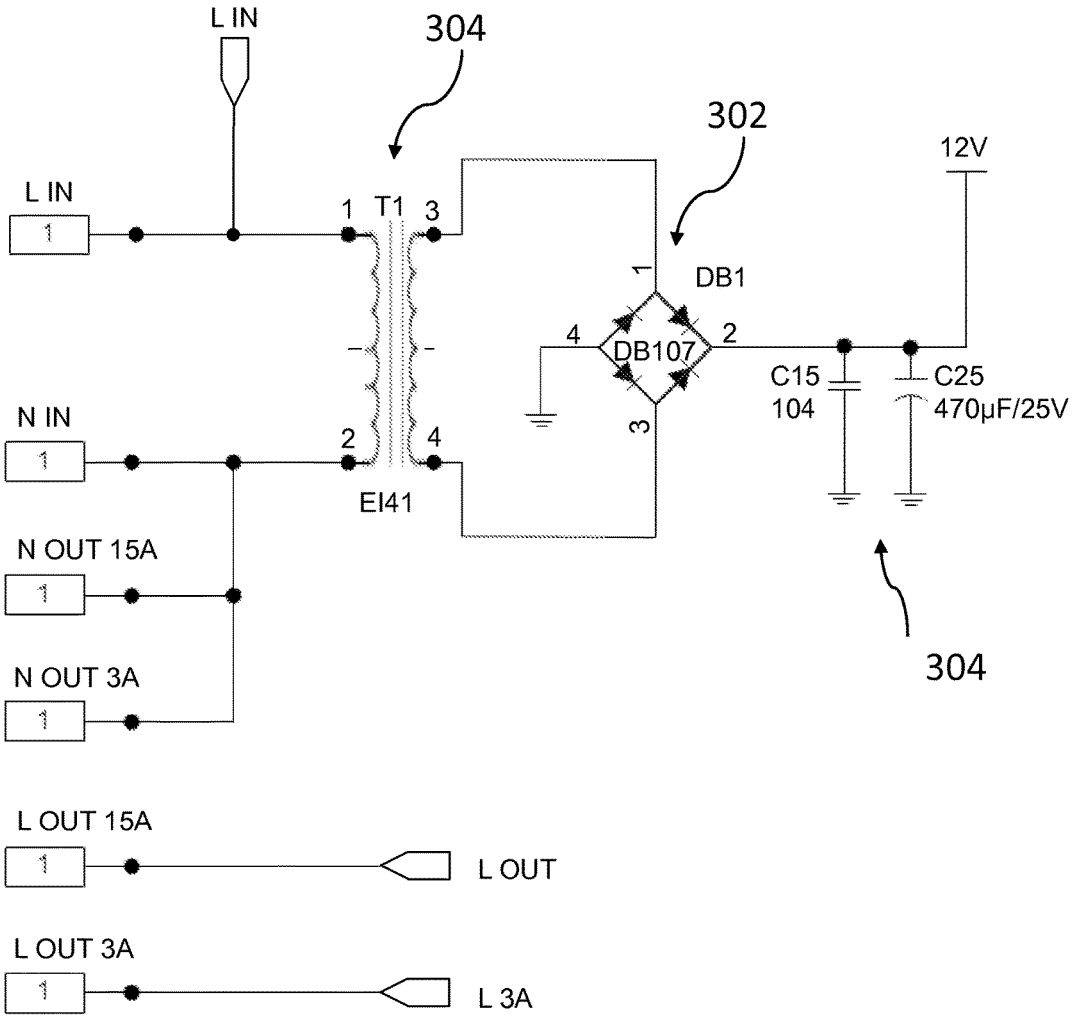
FIG. 3 is a wiring diagram showing an exemplary embodiment of the gas sensing apparatus.

Now referring to the wiring diagram in FIG. 3, an exemplary embodiment of the gas sensing apparatus may be described. The circuit may include but is not limited to a transformer 304, which may be connected to a passivated bridge rectifier 302. A number of electrolytic capacitors may be connected in series to the passivated bridge rectifier 302.

Figure 4A:
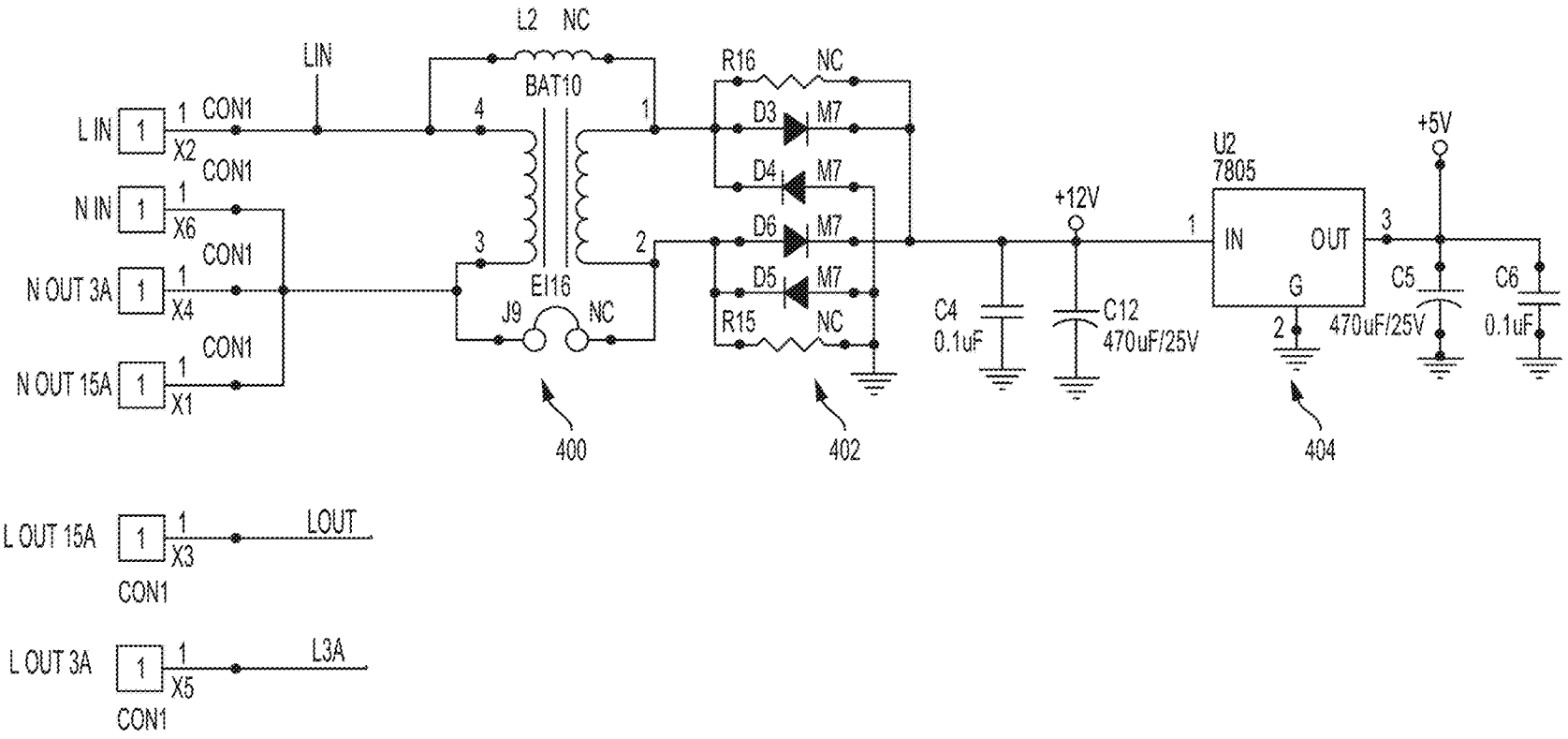
Figure 4B:
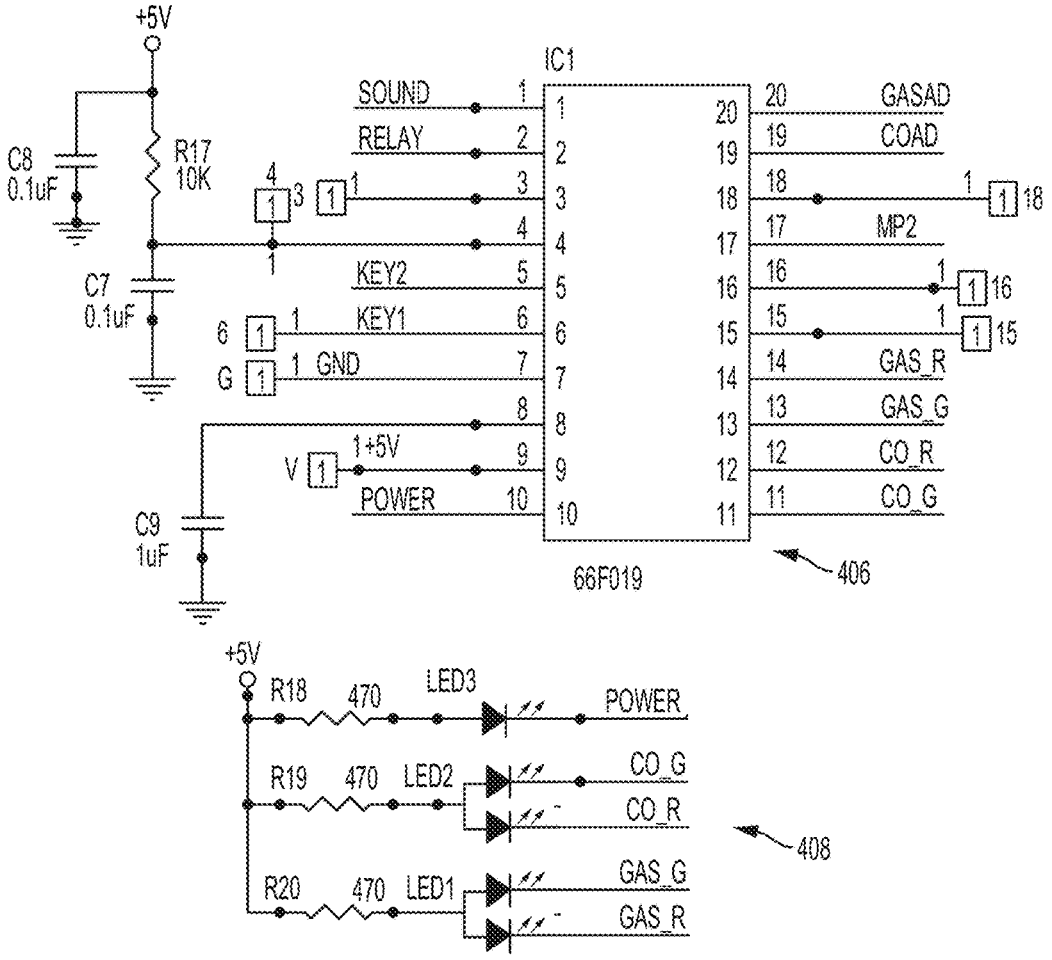
Figure 4C:
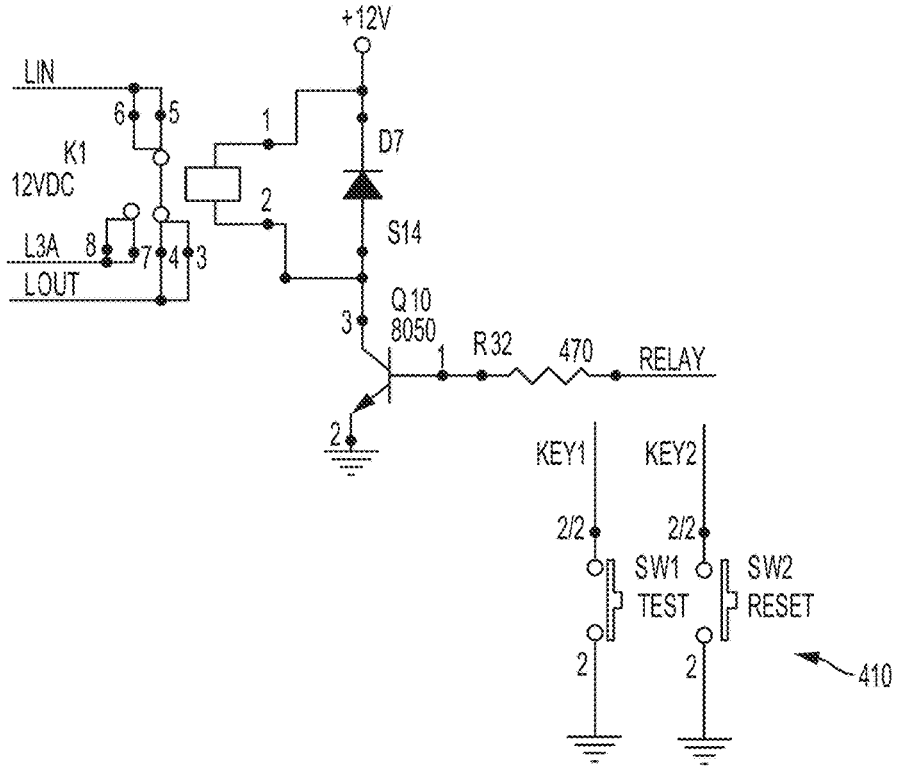
Figure 4D:
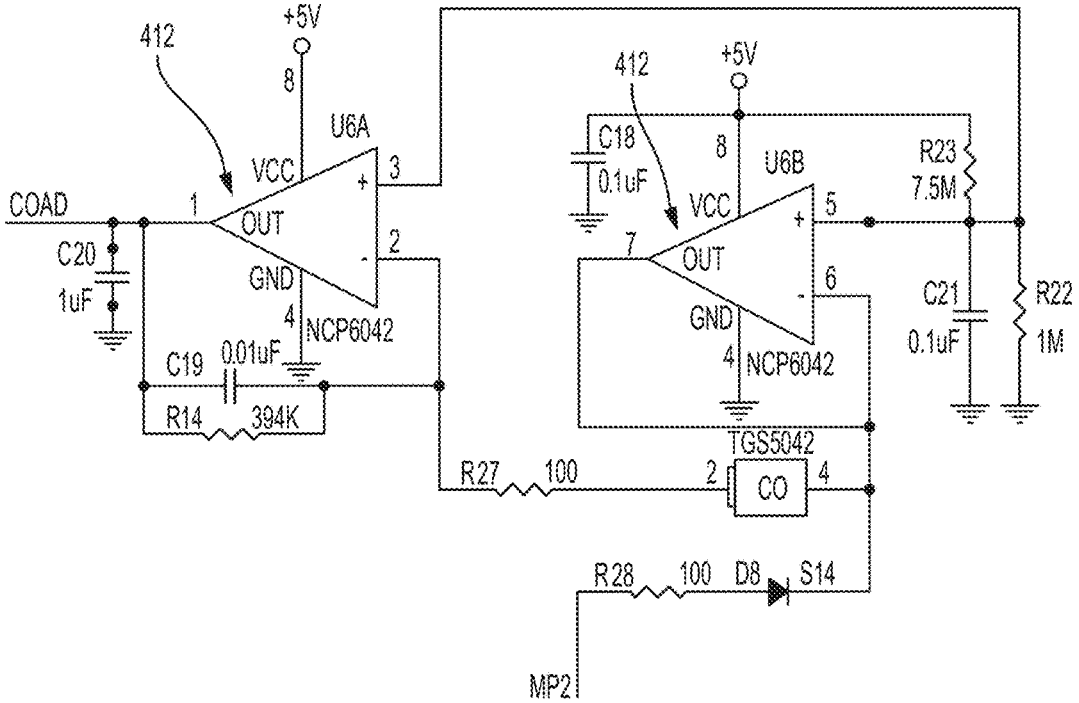
Figure 4E:
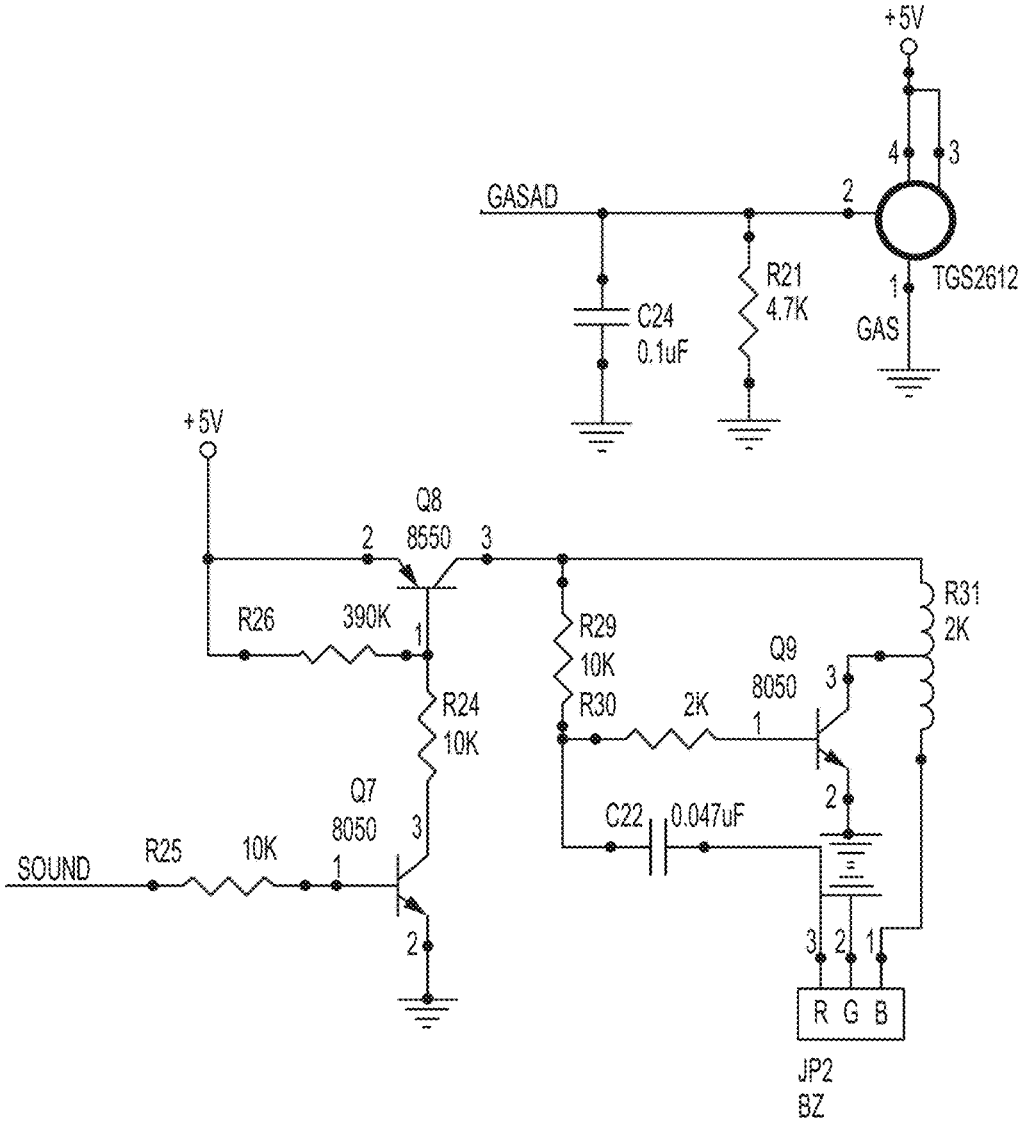

Now referring to the wiring diagrams in FIG. 4*a*-4*e*, an exemplary embodiment of the gas sensing apparatus may be described. The circuit may include but is not limited to a transformer 400, which may be connected to a passivated bridge rectifier 402. A number of electrolytic capacitors may be connected in series to a regulator IC 404.Exemplary diagram 4*b* illustrates an integrated circuit 406 and an array of LEDs 408. Additionally, test and reset switches 410 may be shown in FIG. 4*c* and exemplary FIG. 4*d* may show the wiring of two amplifiers 412. Exemplary FIG. 4*e* illustrate other exemplary embodiments of the wiring diagram. It may be appreciated that any desired components may be added, omitted or substituted and the exemplary FIG. 4*a*-4*e* are an exemplary representation of the gas sensing apparatus's wiring diagram.

Figure 5:
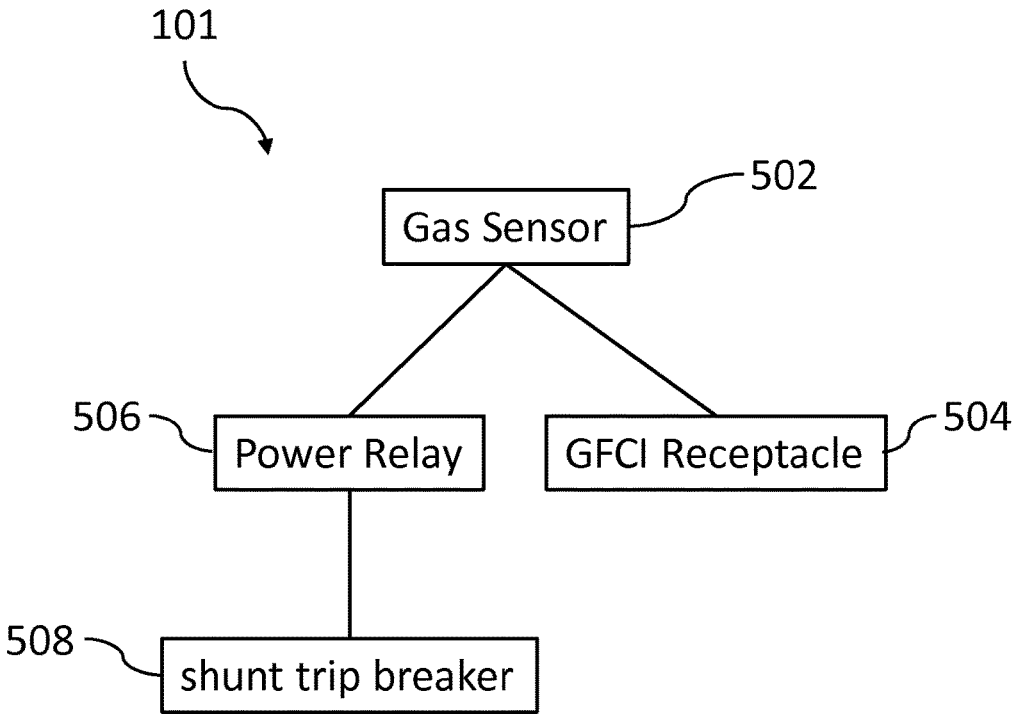
FIG. 5** is a diagram showing an exemplary embodiment of the gas sensing apparatus in relation with a GFCI receptacle and a shunt trip breaker.

Now referring to FIG. 5, an exemplary embodiment of the gas sensing apparatus 100 may be provided. A number of gas sensors 502 may detect gas in the air and may send a surge of power through the wires directly to the GFCI 504 thereby shutting down power. In an alternative embodiment, the gas sensor 502 may detect gas in the air and may send a surge of power through the wires directly to the power relay 506 which in turn sends the surge to the shunt trip breaker 508 thereby shutting down the power to prevent accidental explosion. In the event of a natural gas or propane leak this unit may sense the gas at a low level and may shut down the electrical circuit thereby preventing whatever is plugged into the circuit from creating a spark or other means of ignition to start an explosion. Further, it may be appreciated that the GFCI 504, the power relay 506, and shunt trip breaker 508 may not be necessary on some units. Further, the gas sensing apparatus 100 may be adapted for a number of voltages and amperages. Voltages may include 220V A/C, and 24V DC or any desired specifications. Gas sensors 502 may measure the levels of gas digitally. Further, the receptacle plug may vary in configuration.

In an exemplary embodiment, the gas sensing system maybe be adapted and used for a number of safety and security purposes. It may be appreciated that additional embodiments may include, but not be limited to: a number of sensors, home detection devices, equipment shutdowns, warning systems, and home intrusion. In an exemplary embodiment, the port wire may be used to power a warning light, a siren, a remote alarm system, and may send a surge of power to a shunt trip breaker to kill power. The number of sensors may be supplemented by movement detectors, humidity detector, thermostat, allergen detector, radiation detector, and seismic vibration detector. In a further embodiment, the gas detection apparatus may control systems such as ventilation, HVAC system, and door and window function. It may be appreciated that any desired sensor or system may be adapted and coupled to the gas detector apparatus.

In an exemplary embodiment the gas sensing apparatus may be used in buildings and means for transportation, including, but not limited to aircraft, watercraft, railed vehicles, and motor vehicles.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method for shutting down power of at least two or more power sources when sensing gas comprising:

a gas sensing apparatus comprising:

a portable housing, wherein the portable housing is equipped with mounting elements for securing the portable housing to a desired location, at least one power relay rigidly connected to the inside of the portable housing, at least one sensor connected to the at least one power relay, wherein the at least one sensor is selected from the group comprised of at least one of a carbon monoxide sensor, a H2S sensor, a fuel sensor, natural gas sensor, a butane sensor, and a propane sensor, at least one alarm connected to the at least one sensor, wherein the at least one alarm includes at least one of an audible alarm and a visual alarm, at least one port power wire outlet connected to the at least one power relay, at least one power socket that is a power source of the at least two or more power sources and is connected to the at least one power relay, wherein the at least one power socket delivers a voltage from 12V to 230V, a power transformer connected to the at least one power relay, and a power inlet connected to the at least one power transformer;

connecting the gas sensing apparatus to a power supply via the power inlet to provide power to the gas sensing apparatus via the at least one power transformer;

connecting an electrical device to the as sensing apparatus via the at least one power socket;

connecting an external shunt trip breaker to the at least one port wire outlet;

sensing gas by the at least one sensor, wherein the at least one sensor is configured to provide a signal to the at least one alarm and the at least one power relay when gas is detected;

where in response to reception of said signal:

the at least one alarm provides an indication for the detected gas; and the least one power relay is configured to:

shut down power of the at least one power socket and power up the at least one port power wire outlet to send a power surge to the external shunt trip breaker, so that the external shunt trip breaker shuts down power of another power source of the at least two or more power sources to prevent accidental explosion corresponding to the detected gas.

* * * * *